United States Patent [19]

Weiler

[11] Patent Number: 4,913,581

[45] Date of Patent: Apr. 3, 1990

[54] NARROW TRENCH TAMPER

[75] Inventor: Patrick J. Weiler, Pella, Iowa

[73] Assignee: Vermeer Manufacturing Co., Pella, Iowa

[21] Appl. No.: 371,526

[22] Filed: Jun. 26, 1989

[51] Int. Cl.[4] ..... E01C 19/28

[52] U.S. Cl. ..... 404/117; 404/121; 404/127; 404/133; 37/DIG.18; 172/40; 172/554; 405/271

[58] Field of Search ..... 37/105, 117.5, DIG. 18, 37/142.5, 224; 404/121, 117, 127, 133; 405/271; 172/40, 540, 548, 554

[56] References Cited

U.S. PATENT DOCUMENTS

| | | | |
|---|---|---|---|
| 2,891,335 | 6/1959 | Linneman | 404/121 X |
| 3,427,940 | 2/1969 | MacDonald | 404/117 |
| 3,680,452 | 8/1972 | Mangum | 404/127 |
| 3,822,957 | 7/1974 | Caron et al. | 404/121 |
| 3,909,147 | 9/1975 | Takata | 404/133 X |
| 4,269,535 | 5/1981 | Schultz | 404/117 |
| 4,732,507 | 3/1988 | Arteberger | 404/117 |

FOREIGN PATENT DOCUMENTS

| | | | |
|---|---|---|---|
| 2525252 | 10/1983 | France | 405/271 |

*Primary Examiner*—Randolph A. Reese
*Assistant Examiner*—Franco Deliguori
*Attorney, Agent, or Firm*—Rudolph L. Lowell

[57] ABSTRACT

A narrow self-propelled trench soil compactor has a vibratory frame assembly connected in a towing relation to a mobile frame having steerable front wheels. The vibratory frame assembly is pivotally connected to the mobile frame for vibratory up and down movement independently of the mobile frame. A soil compaction wheel is rotatably supported at the free end of the frame assembly for movement to a lowered operating position and is power driven to function as the propulsion means for the machine. When the compaction wheel is in an elevated or non-operating position, the machine is attachable to a towing tractor for transportation purposes.

5 Claims, 5 Drawing Sheets

NARROW TRENCH TAMPER

This invention relates generally to a soil compactor and, in particular, to a mobile narrow trench soil compactor wherein a vibrating compaction wheel rotatable within a trench also functions as a traction wheel for driving the compactor.

BACKGROUND OF THE INVENTION

In residential districts it is now common practice to provide for the laying of underground cables and irrigation pipe systems. Underground irrigation systems are now also commonly in use for golf courses and the like. If the backfill earth dug from the trench is not compacted sufficiently, there will remain a mound of soil and the tendency of the soil to later settle and form a depression along the line of the underground installation. This results in detracting from the appearance of the lawn or golf course, along with the necessity of incurring additional expense in filling the depression and then sodding or seeding the same.

To overcome this objection in the filling of the narrow trench required for the underground installations, a usual backhoe machine has been provided with a compaction wheel attachment dependent upon the weight of the backhoe for compacting, and the fore and aft movement of the backhoe as a self-propelled mobile frame. The compacting attachment thus requires an expensive machine for its operation and sufficient clearance around the formed trench to allow manipulation of the backhoe.

A further practice has been the utilization of a relatively small portable tamping machine which requires two operators. One operator is necessary to balance and guide the machine in the trench, while the second operator manually pulls the machine through the trench by means of a rope or like connection. These machines are generally ,of a light weight and, even though vibratory in operation, they are difficult and inconvenient to handle, along with requiring substantial maintenance expense and skill in handling.

A further procedure is shown in Pat. No. 3,680,452 herein a compacting roller is centrally supported on the bucket or scoop of a loader machine. In use, the machine straddles the ditch and is piloted back and forth along the ditch to roll and compact the ditch floor. For compaction purposes, the entire front end weight of the loader may be carried by the compacting roller by operating the hydraulic down pressure of the loader so as to transmit the loader weight to the roller. Additional weight may be carried by the roller by partially loading the loader bucket with dirt or rock material. The loader bucket may also carry a pulsating unit to facilitate compaction. The roller at the front end of the loader machine and the manipulation of the loader weight on the roller makes for steering difficulties in following the trench line. Additionally, the weight of the loader machine may result in a collapse of the trench sidewalls or in disfigurement of the ground surface adjacent the trench sidewalls.

SUMMARY OF THE INVENTION

The narrow trench soil compactor of this invention eliminates many of the above mentioned disadvantages of the prior art and provides a mobile self-propelled compactor machine of relatively light weight that is easily and conveniently manipulated to closely follow the trench line for compacting action against the trench floor. A vibratory frame assembly that includes a shaker unit and a narrow width soil compaction wheel is pivotally connected in a following relation with the mobile frame for independent up and down vibratory movement. The compaction wheel is of a construction to operate within trenches having a width of from three inches to twelve inches and a depth of up to about five feet. The compaction wheel is free to follow the irregularities of the ditch floor and functions as the traction wheel of the soil compactor. Steerable front wheels are manipulated by an operator walking along side of the machine so that progress of the compaction wheel within the trench is readily observable for tracking within the ditch. Controls for the compaction wheel, the shaker unit, and steerable front wheels are conveniently accessible to the one-man operator.

DESCRIPTION OF THE INVENTION

Figure 1:
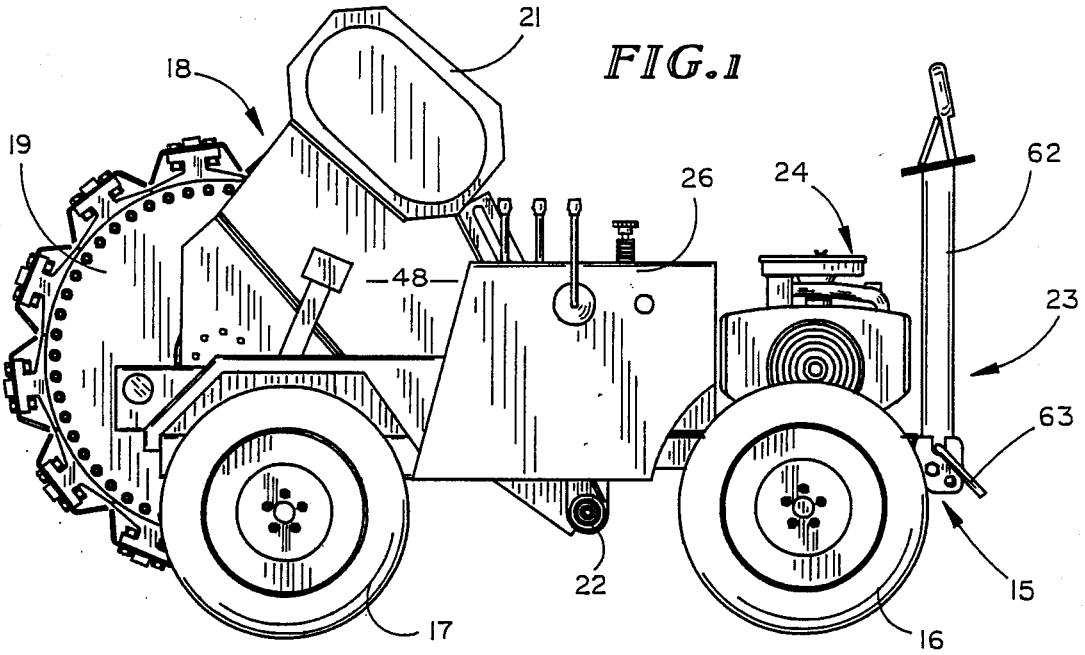
FIG. 1 is a side elevational view of the narrow trench compactor of this invention.
Figure 3:
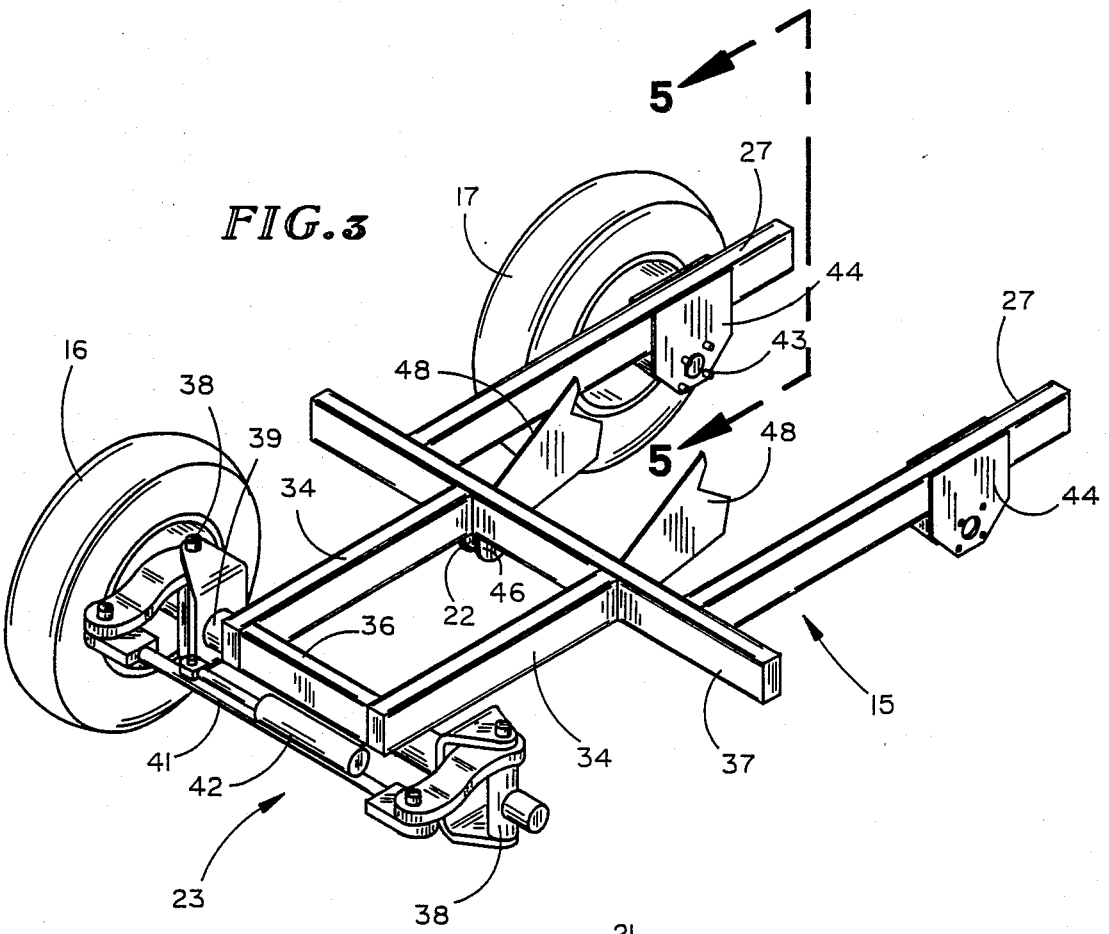
FIG. 3 is a perspective view of the main frame for the compactor machine shown in FIG. 1.

With reference to the drawings, the narrow trench compactor machine of this invention is illustrated in FIGS. 1 and 3 as having a mobile unit with a main frame 15 equipped with front steerable wheels 16 and rear ground wheels 17. A vibratory frame assembly, indicated generally as 18, carries a soil compaction and traction wheel 19 and a shaker unit 21 and, is pivotally supported on the frame 15 at 22 for up and down pivotal movement of the compaction wheel.

The mobile frame 15 has a front portion 23 on which is mounted a primary power means including an engine and hydraulic pump assembly 24 and a valve control unit 26 for selectively controlling the rate of rotation of the compaction wheel 19, the vibrating movement of the vibratory frame 18, and the steering of the front wheels 16. The rear portion of the mobile frame 15 is of a bifurcated construction so as to form a pair of transversely spaced opposite bifurcations 27. The vibratory frame 18 is positioned between the bifurcations 27 with a ground wheel 19 mounted on and positioned to the outside of an adjacent bifurcation 27.

Figure 4:
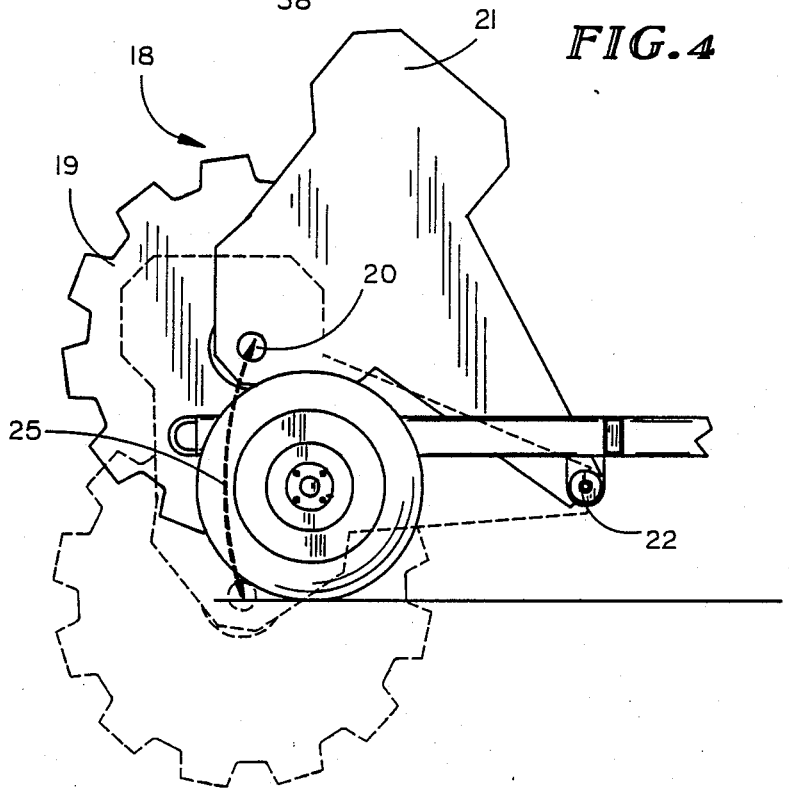
FIG. 4 is a diagrammatic illustration showing the pivotal arc motion of the compaction wheel relative to the axis of the rear ground wheels.

As illustrated in FIG. 4, the vibratory frame 18 is pivoted at 22 on the front section of the mobile frame with the compaction wheel 19 having its axis of rotation 20 pivotally moveable in an arc 25 rearwardly of, but adjacent to, the axes of the rear wheels 17. A double-acting cylinder assembly 28 (FIG. 8) for pivotally elevating and lowering the vibratory frame assembly 18 relative to the frame 15 has one end pivotally connected at 29 to the frame front section 23 and an opposite end pivoted at 31 with the vibratory frame 18.

Figure 2:
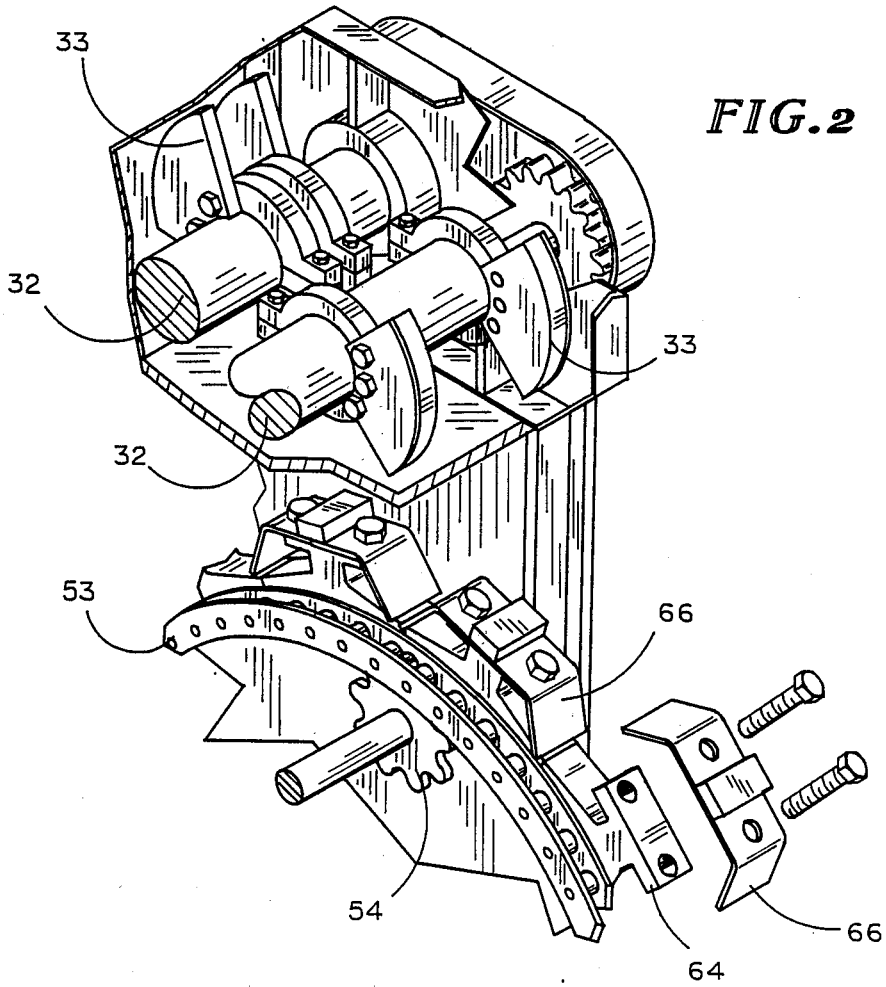
FIG. 2 is an enlarged detailed perspective view with parts broken away for clarity showing the relative arrangement of a shaker unit and compaction wheel that form part of a vibratory frame assembly.

The shaker unit 21 for vibrating the frame 18 about its pivotal axis 22 is of a usual type (FIG. 2) wherein each one of a pair of parallel shafts 32 is equipped with offset non-synchronized weights 33.

The main frame 15 (FIG. 3) includes a forward pair of transversely opposite longitudinal frame members 34 connected across their forward ends by a front transverse member 36. The rear ends of the frame members 34 are connected to a rear transverse member 37 to define the front section 23. The front ends of the bifurcations 27 are connected to the rear transverse member 37 at transversely spaced positions greater than the spacing between the frame members 34. Each front wheel 16 is rotatably supported on a king pin unit 38 pivotally supported at one end of a front axle 39 mounted at the forward end of the frame 15 on the frame members 34. The units 38 are concurrently actuated through a tie rod 41 on the operation of a hydraulic cylinder assembly 42 interconnected between the front axle 39 and the tie rod 41.

Figure 5:
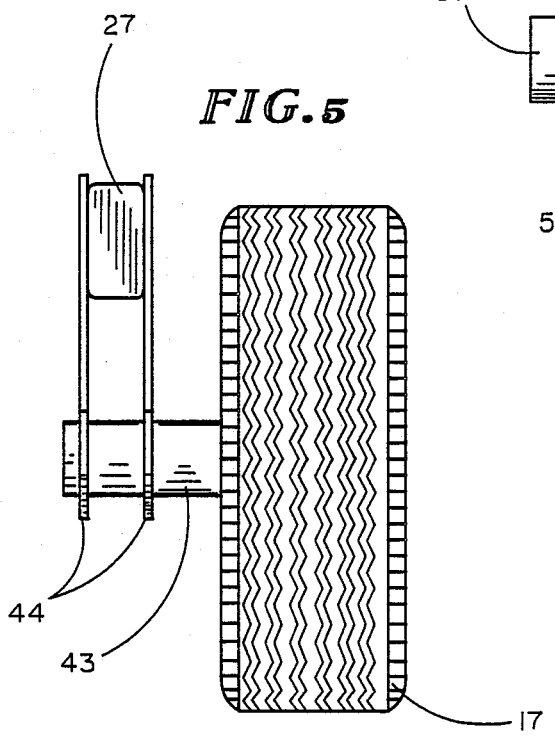
FIG. 5 is an enlarged sectional detail view taken along line 5—5 in FIG. 3.
Figure 6:
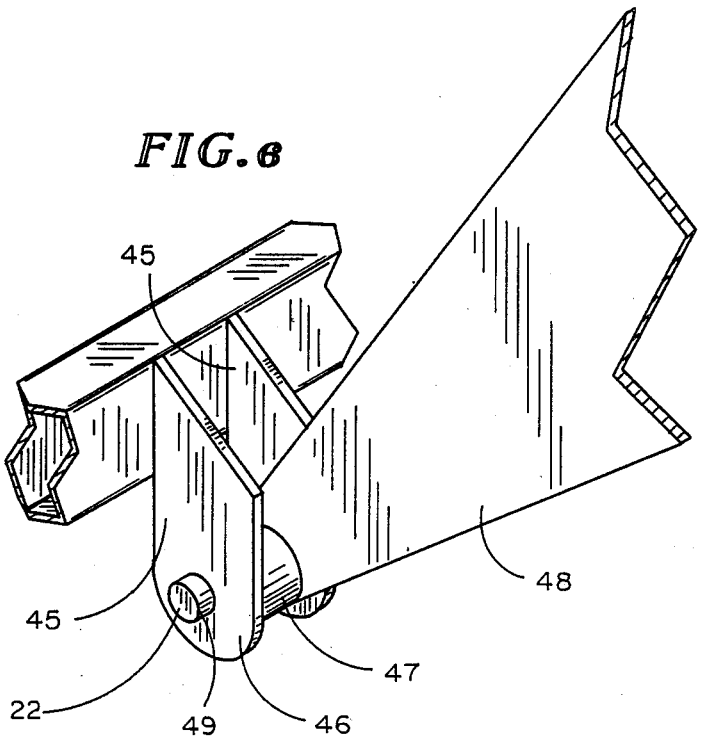
FIG. 6 is a detail perspective view showing the pivotal support of the vibrafory frame on the main frame of the compactor machine.

Each rear wheel 17 (FIGS. 3 and 5) has the axle 43 thereof carried in a pair of transversely spaced mounting members 44 secured to opposite sides of a bifurcation 27 in a pendant relation. Secured to the rear side of the transverse connecting member 37 (FIGS. 3 and 6) are a pair of transversely spaced mounting units 46 for the vibratory frame 18. Each mounting unit 46 includes a pair of spaced upright plate members 45 for receiving therebetween a bearing member 47 that is secured to the lower end of a side plate 48 of the vibratory frame 18. A pivot bolt 49 extendable through the bearing 47 and upright plates 45 pivotally supports the vibratory frame 18 for up and down pivotal movement about its transverse axis 22.

Figure 7:
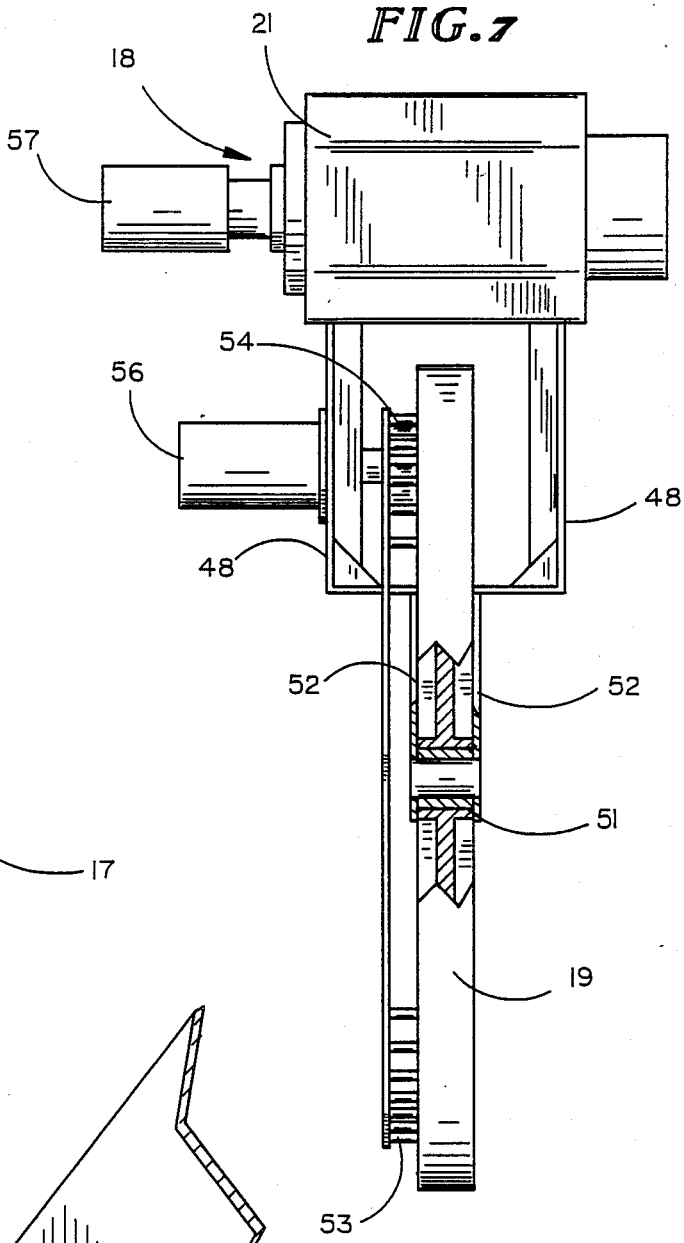
FIG. 7 is a detail elevational view of the rotational support of the compaction wheel on the vibratory frame.

The side plates 48 of the vibratory frame 18 are rigidly connected together in a suitable manner for unitary movement relative to the axis 22. The shaker unit 21 (FIGS. 1 and 7) is supported at the rear end of the frame 18 across the upper sides of the plate members 48. The compaction wheel 19 is positioned between the side plates 48 and below the shaker unit 21 for rotatable support in a bearing unit 51 (FIG. 7) mounted between a pair of hangars 52 carried inwardly of and below the rear ends of the side plates 48 at positions spaced apart a distance of about 3.5 inches for a purpose to later appear. The compaction wheel 19 (FIGS. 2 and 7) is of a flat disc construction and equipped with a rim sprocket 53 operatively associated with a sprocket gear 54 in driven engagement with a secondary power means comprising an hydraulic motor 56. The shaker unit 21 is selectively operable independently of the compaction wheel 19 and is equipped with a hydraulic motor 57.

The cylinder assembly 28 (FIGS. 8 and 9) for raising and lowering the vibratory frame 18 has one end pivoted at 29 to the front portion of the frame 15 and an opposite end thereof pivoted at 31 in a lost motion connection 58 with the frame 18. The pivot 31 is slideable within a slot 59 formed in an upright plate member 61 projected upwardly from the frame 18 at a position forwardly of the shaker unit 21. As indicated in dotted lines in FIG. 8, when the compaction wheel 19 is in its ground engaging position to function as a traction wheel for propelling the compactor machine, the pivot 31 is adjacent the upper end of the slot 59. In the elevated position of the compaction wheel 19, shown in full lines in FIG. 8 to adapt the compactor machine for transport, the cylinder assembly 28 is retracted to position the pivot 31 within the forward end of the slot 59 thus holding the compaction wheel against downward movement. In the compacting position of the wheel 19 within a trench, the cylinder assembly 28 is extended (FIG. 9) to locate the pivot 31 intermediate the ends of the slot 59 to provide for a floating action of the compaction wheel to follow the contour of the soil at the bottom of the trench.

When in use, a tongue structure 62 for attachment to a towing vehicle is moved to an upright folded position (FIGS. 8 and 9) in which it is maintained by a lock pin 63. With the machine straddling a trench to be filled, the vibratory frame 18 is lowered within the trench to its position shown in FIG. 9. With the operator walking along the side of the machine for access to the valve control unit 26, the shaker unit 21 and compaction wheel 19 are concurrently actuated. On rotation of the wheel 19 in one direction, the machine is advanced along the trench being filled, and in a following relation with the trench, by the steering movement of the front wheels 17 under the manipulation of the machine operator walking alongside of the machine. Steering movement is accomplished for both forward and reverse traverse of the machine with a reverse tractive movement of the compaction wheel being accomplished by merely reversing the driving direction of its hydraulic motor 56. To complement its compacting action, the weight of the wheel 19 may be varied by being of a hollow construction and then filled with a material of high density.

To accommodate the machine to compact trenches of different widths, the rim of the wheel 19 is equipped with circumferencially spaced mounting blocks 64 (FIG. 2) for releasable connection with pad members 66. It is contemplated that the pads be of varying widths ranging in dimension from about 3.5 inches to 12 inches. When the compaction wheel 19 is in its traction position (FIG. 8) for propelling the machine along the ground surface the pads 66 may, at times, deface the lawn or other landscape surface. To avoid this occurrence the machine may be equipped with a front wheel axle (not shown) drive for the front wheels 16 arranged in operative association with the engine of the assembly 24. With the compaction wheel 19 in its elevated position of FIG. 8, the front wheels can then function both for steering and traction purposes.

Figure 8:
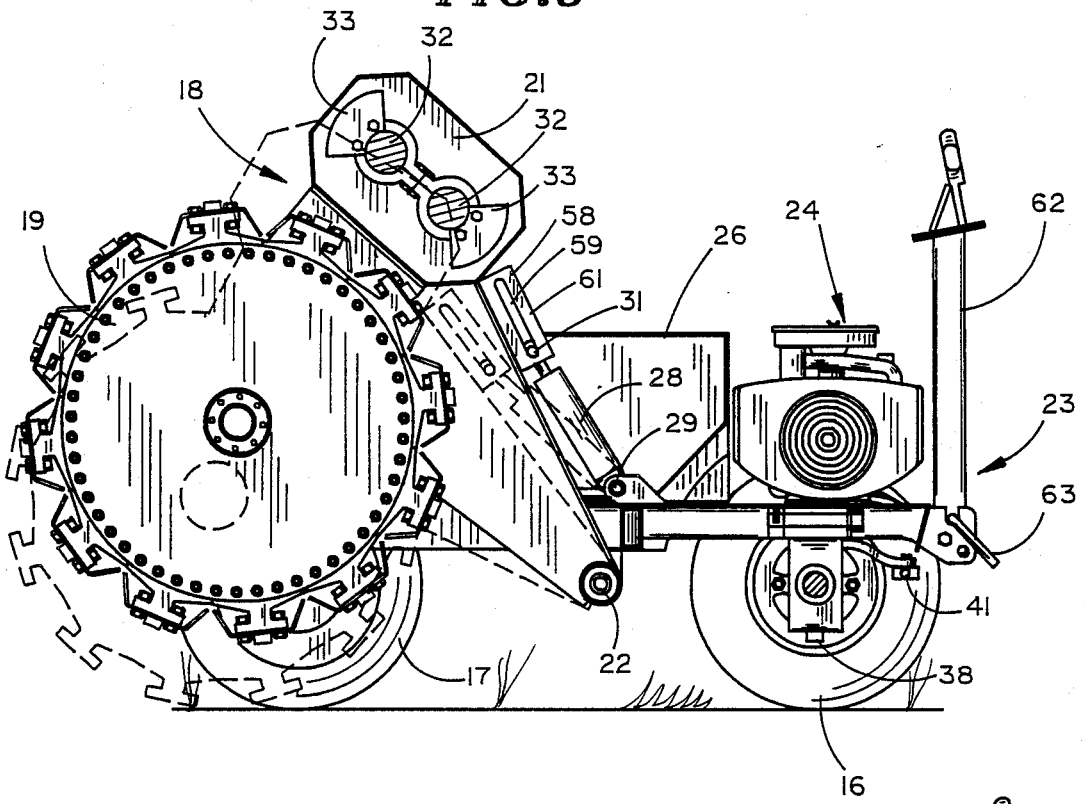
FIG. 8 is a side view of the soil compactor machine with the compaction wheel in an elevated position above the ground surface.
Figure 9:
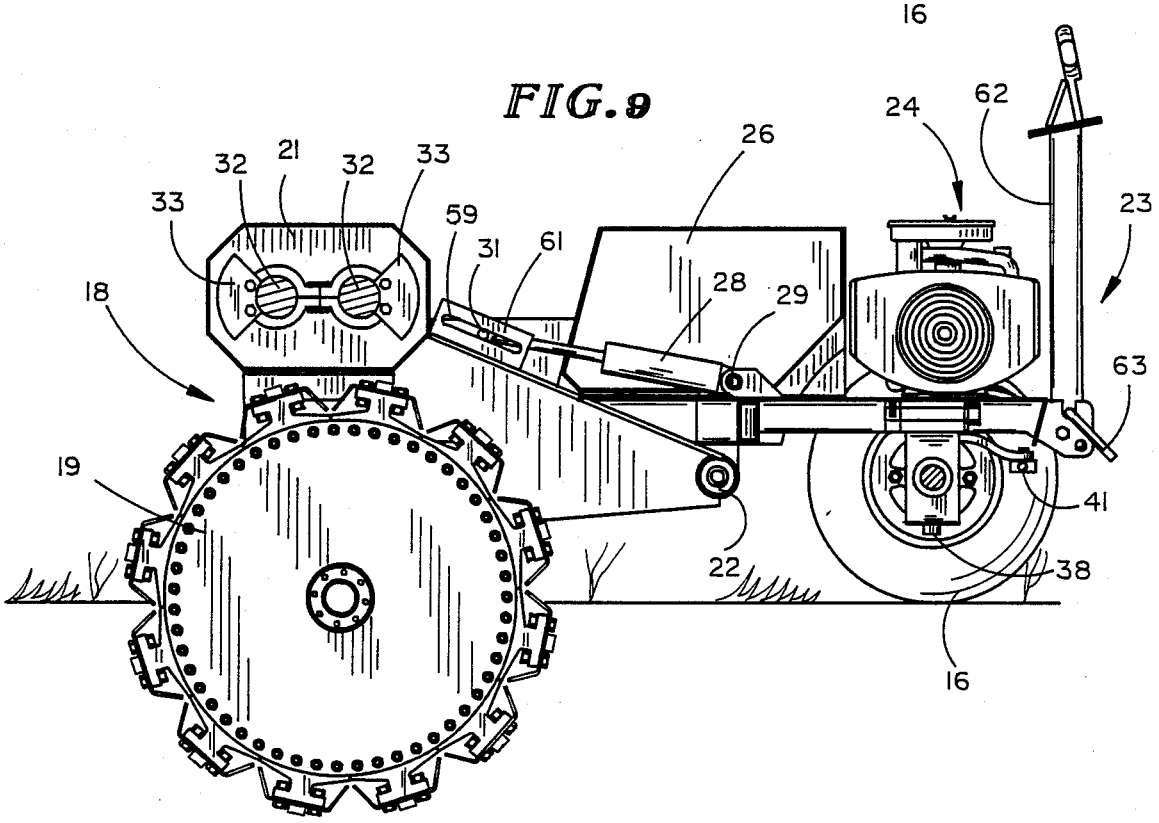
FIG. 9 is illustrated similarly to FIG. 8 and shows the compaction wheel in a lowered operating position.
Figure 10:
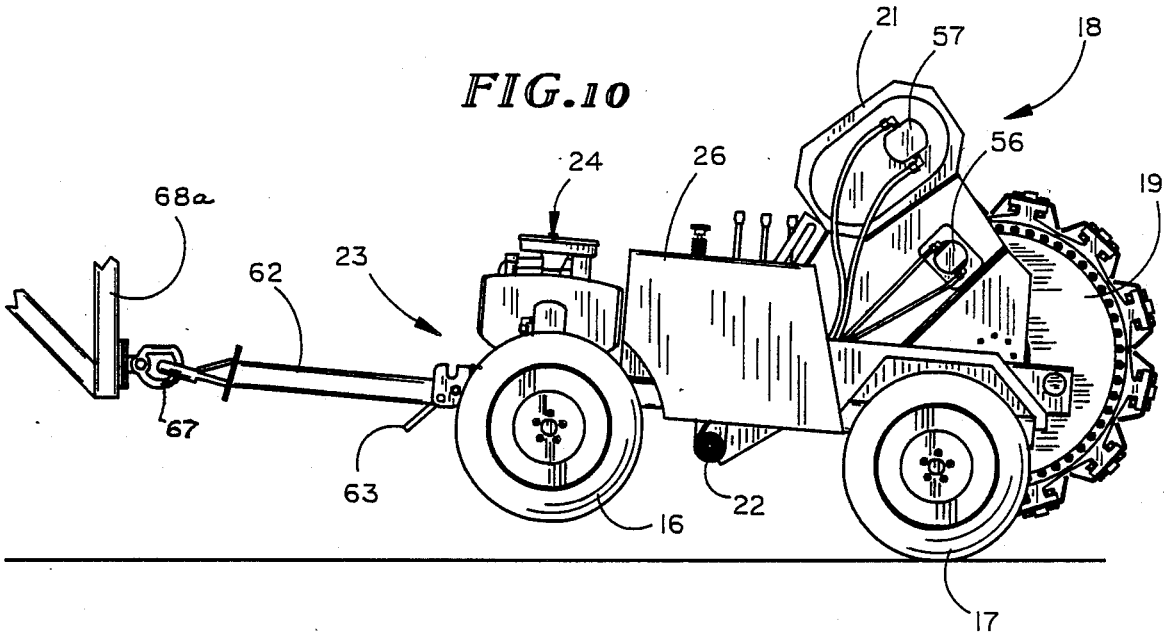
FIG. 10 is illustrated similarly to FIG. 8 and shows the compaction machine in assembly relation with a towing vehicle for transport purposes.

In transporting the machine from one job location to another, the tongue structure 62 is moved from its folded position of FIGS. 8 and 9 to a locked unfolded position shown in FIG. 10 wherein the tongue projects rigidly forwardly of the machine. With the hitch attachment 67 on the towing vehicle **68*a* at an elevation higher than the rotational axis of the front wheels 16**, the front of the machine is elevated to raise the front wheels in a clearance relation with the ground. In one embodiment of the machine, the wheel base is on the order of about six feet with the compaction wheel having a diameter of about four feet. When narrow trenches having a depth of about five feet are to be filled and compacted, the compaction wheel may be increased to a diameter of about eight feet with the machine dimensions being correspondingly increased.

Figure 11:
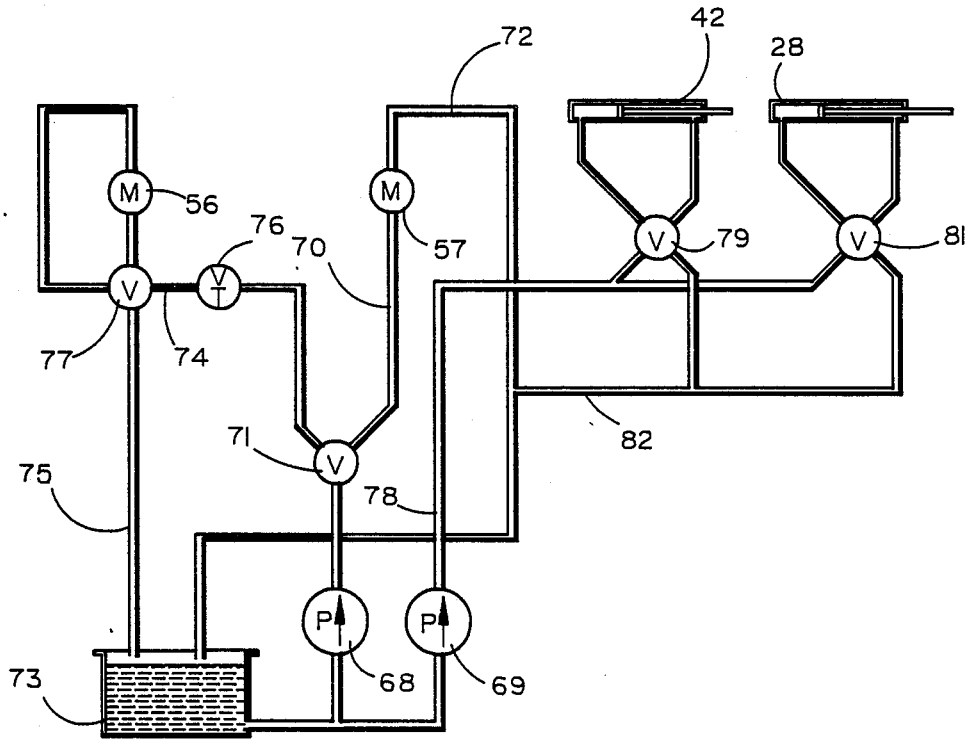
FIG. 11 is a diagrammatic illustration of the hydraulic control system for the soil compaction machine.

With reference to FIG. 11, there is diagrammatically illustrated a hydraulic control system for the compactor machine. The pump and engine assembly 24 includes a pair of fluid pumps 68 and 69, each of which has the inlet thereof connected to a fluid reservoir 73. The pump 68 is operatively associated with the shaker motor 57 and the compactor wheel motor 56. The outlet of the pump 68 is connected to a selector valve 71, which, in one position provides for the concurrent operation of the motors 56 and 57 and in a second position for operation alone of the compaction wheel motor 56. A fluid line 70 connects the selector valve 71 with the inlet of the shaker motor 57 that has an outlet connected to a fluid line 72 open to the fluid reservoir 73. The inlet of the compactor wheel motor 56 is connected to the selector valve 71 by fluid line 74. In order from the selector valve 71 and interconnected in the fluid line 74 is a speed control valve 76 and a valve 77 having neutral and forward and reverse positions for controlling the operation of the compaction wheel motor 56. Valve 77 is connected to the reservoir 73 by a return line 75.

The pump 69 has its outlet connected to a feed line 78 that is common to control valves 79 and 81 for the front wheel steering cylinder 42 and vibratory frame lift cylinder 28, respectively. The cylinders 42 and 28 are of double-acting type and are connected by a common fluid return line 82 to the reservoir 73.

Although the invention has been described with respect to a preferred embodiment thereof, it is not to be so limited since changes and modifications can be made therein within the intended scope of the invention as defined in the appended claims.

I claim:

1. A narrow trench soil compactor comprising:

(a) a self-propelled mobile unit with a main frame having a pair of transversely opposite rear wheels and steerable front wheels and a wheel base of about six feet;

(b) a vibratory frame assembly, including a shaker unit and a rotatable soil compacting wheel;

(c) means pivotally connecting the vibratory frame assembly to the main frame for up and down vibratory movement of said soil compacting wheel between said rear wheels;

(d) primary power means on the main frame for driving said soil compacting wheel to propel said mobile unit;

(e) secondary power means on the vibratory frame assembly for driving said soil compacting wheel to propel said mobile unit; and (f) means providing for a free floating pivotal movement of the vibratory frame assembly whereby the compaction wheel is permitted to follow the contour of the soil at the bottom of the trench.

2. The soil compactor according to claim 1 wherein:

(a) said mobile frame has a bifurcated rear end portion to provide a pair of transversely opposite longitudinally extended bifurcations, with said vibratory frame assembly positioned between said bifurcations.

3. The soil compactor according to claim 2, including:

(a) means rotatably supporting each of said rear ground wheels on an adjacent bifurcation, with said ground wheels having the axes of rotation thereof located forwardly of the axis of rotation of said soil compacting wheel.

4. The soil compactor according to claim 1, including:

(a) said primary power means including a hydraulic source of pressure supply on said mobile frame;

(b) a first hydraulic motor for driving said shaker unit;

(c) said secondary power means comprising a second hydraulic motor for driving said soil compacting wheel; and (d) a hydraulic control system connecting said hydraulic pressure source with said first and second hydraulic motors, including a valve control unit mounted on said mobile frame.

5. The soil compactor according to claim 1, including:

(a) means for moving said vibratory frame assembly to an elevated transport position for said soil compacting wheel above the ground surface and to a lowered operating position of said compacting wheel;

(b) tongue means mounted at the forward end of the mobile frame for movement to a first folded upright position when the compacting wheel is in the operating position therefor, and to an unfolded position projected forwardly from the mobile frame for connection to a towing tractor when the compacting wheel is in the transport position therefor;

(c) means for securing said tongue means in the unfolded position therefor against up and down movement relative to the mobile frame; and (d) means for attaching said tongue means in the unfolded position therefor to a towing tractor at a height to provide for the elevation of said front wheels out of ground engagement.

* * * * *

UNITED STATES PATENT AND TRADEMARK OFFICE

CERTIFICATE OF CORRECTION

PATENT NO. : 4,913,581

DATED : April 3, 1990

INVENTOR(S) : Patrick J. Weiler

It is certified that error appears in the above-identified patent and that said Letters Patent is hereby corrected as shown below:

Column 5, lines 54-56 "Driving said soil compacting wheel to propel saidmobile unit" should be deleted.

Signed and Sealed this

Thirty-first Day of December, 1991

*Attest:*

HARRY F. MANBECK, JR.

*Attesting Officer*

*Commissioner of Patents and Trademarks*